United States Patent [19]

Maruyama et al.

[11] Patent Number: 4,536,676

[45] Date of Patent: Aug. 20, 1985

[54] LAMP ASSEMBLY

[75] Inventors: Jisaburou Maruyama, Yokosuka; Sumio Fukayama, Yokohama; Masanobu Miyake, Yokosuka; Yoshimi Watanabe, Yokohama; Yoshinori Eguchi, Kawasaki, all of Japan

[73] Assignee: Tokyo Shibaura Denki Kabushiki Kaisha, Kawasaki, Japan

[21] Appl. No.: 536,732

[22] Filed: Sep. 28, 1983

[30] Foreign Application Priority Data

Sep. 30, 1982 [JP] Japan ..... 57-171812

[51] Int. Cl.[3] ..... A47B 88/00

[52] U.S. Cl. ..... 313/318; 313/315; 339/144 R

[58] Field of Search ..... 339/144 R; 313/318, 313/315

[56] References Cited

U.S. PATENT DOCUMENTS

| | | | |
|---|---|---|---|
| 2,088,544 | 7/1937 | Braselton | 313/315 X |
| 2,200,954 | 5/1940 | Glassberg | 313/318 X |
| 3,237,622 | 8/1943 | Craig | 313/318 |
| 3,551,725 | 12/1970 | Brundige | 339/144 R X |
| 4,039,886 | 8/1977 | Scherzer | 313/318 |

FOREIGN PATENT DOCUMENTS

| | | |
|---|---|---|
| 362368 | 1/1924 | Japan . |
| 3929310 | 4/1937 | Japan . |
| 438930 | 9/1939 | Japan . |
| 5222995 | 10/1973 | Japan . |

*Primary Examiner*—Robert Lindsay

*Attorney, Agent, or Firm*—Oblon, Fisher, Spivak, McClelland & Maier

[57] ABSTRACT

An incandescent lamp assembly has a generally elliptical vitreous envelope including a cylindrical neck, stem mount with a pair of lead-in wires, and a screw-in base capped on the cylindrical portion of the envelope. The cylindrical neck of the envelope has a circular protruded ring along the entire periphery thereof and in the corresponding position of the screw-in base is provided a concave channel, for a push-in coupling. A flared rim is integrally formed with the concave channel and extends gradually outwardly to bear along the envelope, giving elastic deformation to the upper half of the screw-in base. The lead-in wire is interposed between the cylindrical neck and the screw-in base and fixedly positioned at the circular protruded ring. For prevention of relative rotational movement, heat resistant silicone rubber is applied on the circular protruded ring.

6 Claims, 5 Drawing Figures

LAMP ASSEMBLY

BACKGROUND OF THE INVENTION

1. Field of the Invention

The present invention relates to a lamp assembly, and more particularly, to an improved incandescent lamp assembly with a screw-in base that is durable, resistant to shocks and vibrations, heat resistant, and long lasting. The lamp assembly also ensures convenience and ease of manufacture and assembly.

2. Description of the Prior Art

Although not necessarily limited thereto, the invention has particular application to and will be described with reference to an incandescent lamp for general use.

In conventional incandescent lamp assemblies it is common practice to provide a threaded screw-in base to be connected with an outer bulbous envelope.

The bulbous envelope is usually shaped into a generally elliptical or round globe having a cylindrically extending neck. To the neck of the envelope is fused and combined with a glass stem mount having a pair of lead-in wires between which a tungsten filament is bridged. A conventional screw-in base is secured around a mold portion by means of a cement by which it is connected to the neck of the envelope. The primary components of the conventional cement are: marble flour (approximately 80% of the total weight), phenol resin, pine resin, silicon resin, shellac, and hardener.

Although the bond between the two components is designed to hold for the lifetime of the lamp, it is subject to breakdown because the cement is often vulnerable to heat generated at the filament and to humidity from the ambient air. With the lapse of hundreds of hours of operation the cement will absorb humidity from the ambient air and deteriorate and tend to give way.

Also, since incandescent lamps are occasionally mounted and dismounted by the users, shearing forces recurringly develop between the neck of the envelope and the inner surface of the metal screw-in base, causing cracks within the cement, which results in a loose bond, or worse, separation.

A loosely fit base poses a serious hazard to the lamp users, particularly when the lamp is in use with the screw-in base above the envelope; the fragile glass envelope may then fall upon the users.

Japanese Utility Model Publication No. 43-8930 (Shimazu) discloses an assembly of an incandescent lamp in which the neck is provided with four circumferentially and substantially equally spaced-apart outwardly protruded ridges, each further having a projection at its extreme. In the same vein, the screw-in base is provided with a housing cap which has adjacent its flared rim four circumferentially and substantially equally spaced-apart outwardly protruded ridges.

The protruded ridges extend longitudinally, each also having a further external projection at the lower end. The ridges and the projections are formed to fit those of the envelope neck. Thus when they are assembled the lamp assembly is most likely resistant to longitudinal and revolving forces.

On the other hand, however, it has been found that in large scale production of lamps of such type it is extremely time and labor-consuming to adjust the positions of the ridges for proper alignment, so that there has resulted a severe reduction of productivity.

Also in the prior art, one of the lead-in wires was welded to the screwshell for firm electrical contact. But welding required substantial time and labor.

The Japanese Utility Model Publication No. 52-22955 shows a small lamp assembly which is generally used as a light source used outdoors during road repairs and maintenance. The lamp is entirely housed in a resin shock-absorbing covering. Such a lamp assembly eliminated the need for welding the lead-in wire by providing a small allowance between the outer diameter of the neck of the covering and the inner diameter of the screwshell, with the neck being tapered or stepped to permit the screw-in base to be inserted upwards. The dimension of the margin between the neck and the screw-in base is such that the two components apply appropriate pressure to keep the lead-in wire interposed therebetween.

Nevertheless, upon application of external force on the covering or on the screw-in base, the connection may slip and fail. Also, since the covering is made of resin it is vulnerable to heat and hence the technology is suited only to lamps with low light output, which produce less heat.

SUMMARY OF THE INVENTION

It is therefore an object of the invention to provide a lamp assembly with a reduced chance that the connection between a glass envelope and a screw-in base will loosen or separate.

It is another object of this invention to provide a lamp assembly which is durable, heat resistant, resistant to vibrations and shocks and repetitive mounting and dismounting from the lighting fixtures.

A further object of the invention is to provide a lamp assembly in which a lead-in wire is securely and fixedly connected to the electrical terminal, i.e. screwshell, and free of contact failure.

Briefly stated, the objects of the invention are accomplished through providing a projected circular ring around the entire periphery of the neck of the envelope and a concave channel inside the screw-in base at the corresponding position, in addition to the threaded portion, thus allowing the screw-in base to cap the envelope. The screw-in base is also provided with an outwardly flared rim adjacent the concave channel which resiliently engages the upper portion of projected ring after the screw-in base has been properly capped over the mold portion at the bottom of the globe, and thus prevents separation therefrom.

The gap provided between the neck and the screw-in base is set small to permit close coupling.

Caught between the screw-in base and the neck is one of the lead-in wires, which is securely held in the space by setting the gap smaller than the diameter of the lead-in wire.

The mating surfaces are provided with an adhesive, preferably, a heat-resistant silicone rubber adhesive, to fill the space therebetween, which prevents any relative rotational movement of the two elements.

BRIEF DESCRIPTION OF THE DRAWINGS

This invention will be more fully described hereinafter in conjunction with the accompanying drawings in which.

DETAILED DESCRIPTION OF THE PREFERRED EMBODIMENTS

Figure 1:
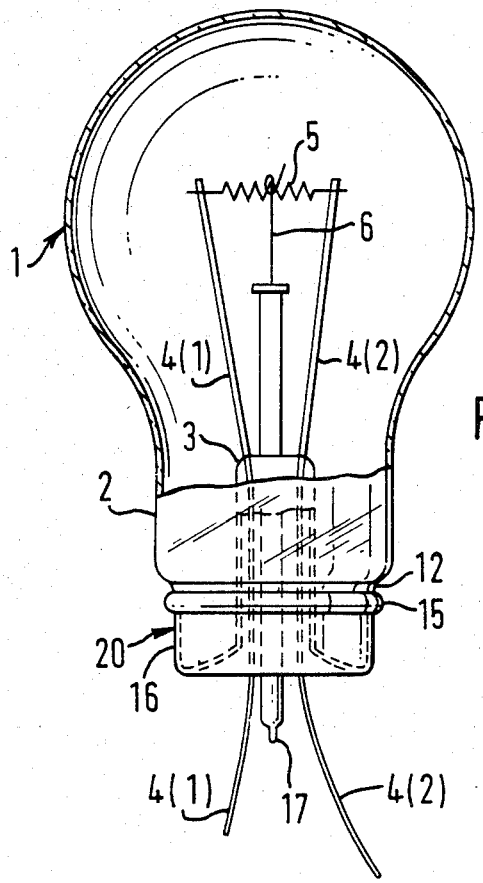
FIG. 1 is a front elevation section view of a vitreous envelope with a stem mount of an incandescent lamp assembly according to one embodiment of the present invention.

Referring now to FIG. 1, the lamp includes a generally elliptical or round external vitreous envelope 1. The envelope includes a cylindrical neck 2 at the lower half which extends downwardly with a curvature from the upper elliptical half and ends with a mold portion 20 at the bottom.

Inside the envelope 1 is provided a glass stem mount 3 which is substantially vertically elongate along the central axis of the envelope and includes a pair of lead-in wires 4(1) and 4(2). One of the lead-in wires 4(1) is a fuse wire while the other is copper wire. The lead-in wires 4(1) and 4(2) are secured by the stem 3 and extend upright with a slightly opened taper in the upward direction as $4_1$ and $4_2$. On the top of the lead-in wires is bridged a tungsten filament 5. The filament 5 becomes a light source when the lamp is in operation, and may be of a double coil type depending upon the required light output.

Midway between the two extremes, the filament is supported by an anchor 6. The anchor 6 has an end loop encircling the filament 5 with a proper spacing. The spacing is so adjusted as to allow the free movement of the filament 5 but to prevent it from excess horizontal or vertical movements, deformation and drooping.

Towards the upper portion of the mold portion 20 a slightly upward tapered circumferential skirt 12 is provided.

Disposed adjoining the tapered skirt 12 is a circular protruded ring 15 which is provided along its entire periphery with a uniform height and curvature. From the circular protruded ring 15 down, a tubular portion 16 is formed, to the bottom of which portion the glass stem mount 3 is integrally welded.

In the center of the glass stem mount 3 is also welded and sealed an exhaust tube 17 connecting the interior of the envelope 1 and ambient open air and through which internal air and impure gases are withdrawn, forming a near-vacuum, after which inert gases are introduced into the envelope.

Figure 2:
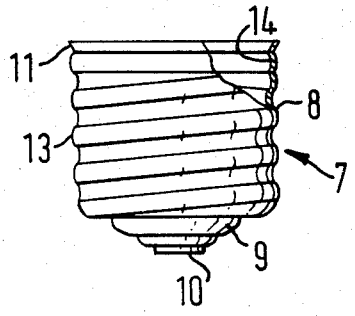
FIG. 2 is an elevation view of a screw-in base in accordance with the invention to be coupled over the lamp envelope shown in FIG. 1.
Figure 3:
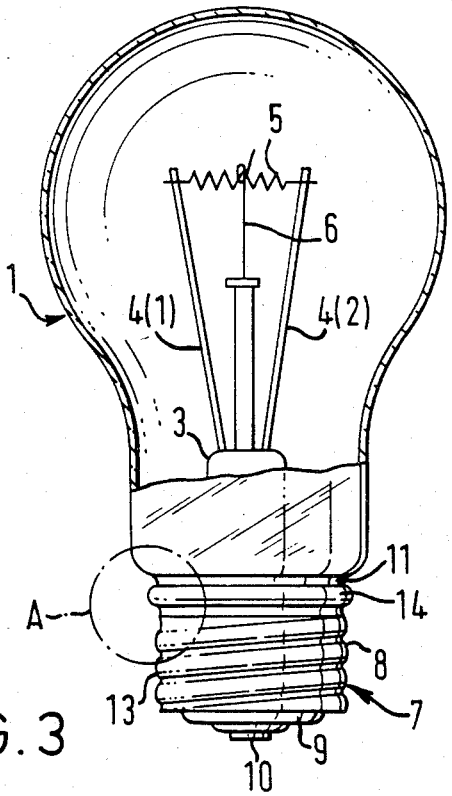
FIG. 3 is a partially sectional elevation of the entire lamp assembly in which the envelope in FIG. 1 and the screw-in base in FIG. 2 are assembled.

Referring now to FIGS. 2 and 3 of the drawings, the screw-in base 7 is press-formed of aluminum with a thickness of 0.3 mm and includes a screwshell 8 which is provided with thread 13 having a height h, and serves as an electrical terminal. To serve as another electrical terminal, central contact 10 is positioned at the approximate axis of the lamp. The central contact 10 is made of electrically conductive material, such as brass, and is isolated from the screwshell by means of an electrically non-conductive material, such as glass. The upper edge is expanded and forms a flared rim 11 to be adapted to the tapered skirt 12 of the envelope 1 in FIG. 1. The rim 11 is adjoined by a concave channel 14 inside the screwshell 8. The channel 14, when the screw-in base 7 is capped over the tubular portion 16, surrounds the circular protruded ring 15 along their overall peripheries.

Figure 4:
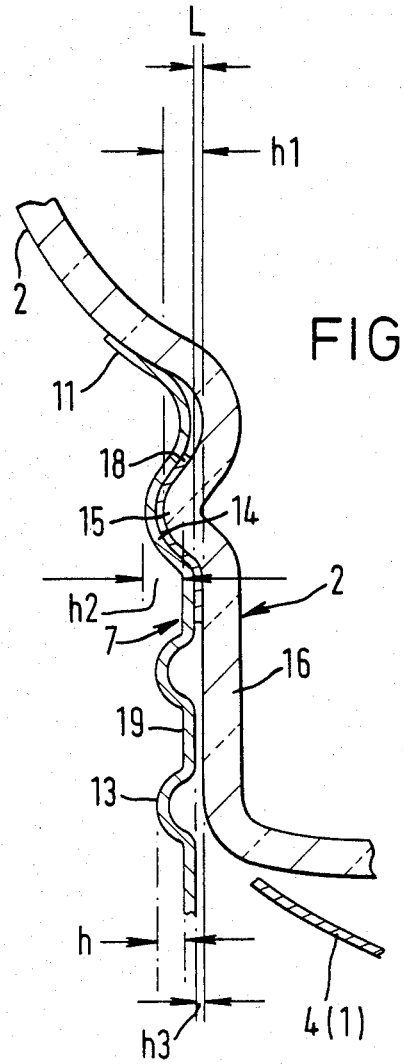
FIG. 4 shows an enlarged fragmentary elevation of the position A of FIG. 3, which is the connection between the envelope and the screw-in base.

In FIG. 4, an enlarged section of the connection between the envelope 1 and the screw-in base, marked as A in FIG. 3 is detailed. The circular protruded ring 15 of the envelope 1 is located in the concave channel 14. Prior to this, the screw-in base 7 is pushed upwards so that the flared rim 11 resiliently expands and moves over the protruded ring 15. However, for the purpose of avoiding plastic deformation of the flared rim 11 the dimensions of each element must be carefully regulated. A flat spiral groove 19 is formed between the turns of the thread 13.

In a preferred embodiment of the invention using a screw-in base the type of which, for example, is E26d (IEC: International Electrotechnical Committee), having a thickness 0.3 mm and a maximum heat endurance of 210 C.; the height h1 of the protruded ring 15 should be kept below 0.5 mm, or more preferably, within the range between 0.25 mm and 0.45 mm. Also, the radius of curvature of the protruded ring 15 should be limited to 1.0 mm, or preferably within the range of 0.6 mm and 0.8 mm. Similarly, the depth h2 of the concave channel 14 is kept below 0.5 mm.

The clearance L to be provided between the tubular portion 16 and the screw-in base 7 also should be regulated to below 0.5 mm, more preferably between 0.1 mm and 0.3 mm. The gap h3 between the inner surface of the groove 19 and the outer surface of the outer tube portion 16 at groove 19 is smaller than the diameter of the lead-in wire 4(1) so that the wire deforms and expands the groove 19 and is tightly held thereby.

In the space defined by clearance L is provided a heat-resistant silicone rubber adhesive 18 for permanent bonding of the base 7 to the envelope 1. The clearance control is particularly essential since the adhesive strength becomes stronger with clearances below 0.5 mm and maximized for clearances between 0.1 mm and 0.3 mm. In a preferred embodiment the silicone rubber adhesive to be used is TSE 322 ot TSE 326 (T. M. of TOSHIBA SILICONE CO.), both being a heat-cure type.

The conventional lamp assembly needed a much larger gap than the current invention because it used cement for securing the glass envelope and the screw-in base, and a relatively large amount of cement was necessary for desired adhesive strength. However, although cement is effective in the start-up phase, it absorbs moisture and weakens over time. Also, cracks tend to develop within the cement, resulting in a loose bulb-base connection.

The application of silicone rubber adhesive need not be around the entire circumferences of the neck of the envelope, but may suffice at a plurality of peripheral points, i.e. points circumferentially equally spaced-apart. In a preferred embodiment, as shown in FIGS. 3 and 4, a very thinly spread silicone rubber adhesive is coated on two circumferentially opposed portions. The quantity of silicone rubber applied to one portion may be between 0.001 grams and 0.1 grams, and in the illustrated embodiment, 0.002 grams.

Figure 5:
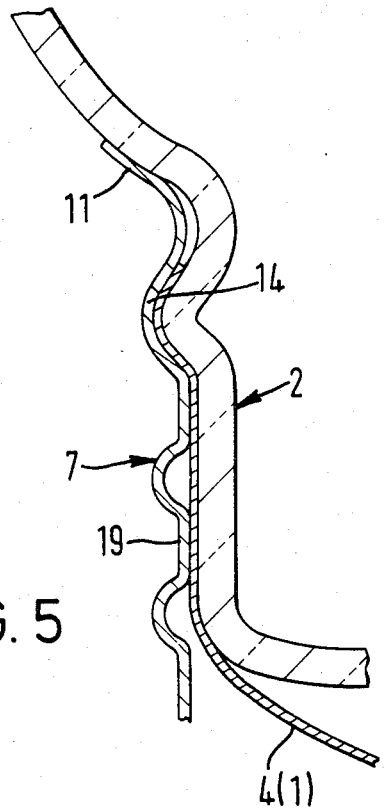
FIG. 5 shows one of the lead-in wires being caught between the neck of the envelope and the inner surface of the screw-in base.

As shown in FIG. 5, when the screw-in base 7 is capped upon the tubular portion 16 the flared rim 11 is forced to expand outwardly in order to surmount the circular protruded ring 15. The degree of expansion is such that it allows the outflared rim 11 and the upper half of the concave channel 14 to elastically deform and apply inward compression to the circular protruded ring 15.

In this invention, one of the lead-in wires 4(1) may also be confined in the inner space between the base 7 and the envelope 1 and securely held by the concave channel 14. Also, the space h3 provided by the flat groove 19 (FIG. 4) is made smaller than the diameter of the lead-in wire 4(1), so that when the screw-in base 7 is capped on the lead-in wire 4(1), the wire deforms a portion of the flat groove 19 of the screwshell 8 lengthwise and is immovably caught thereby. Accordingly, the lead-in wire 4(1) is tightly fixed to the terminal, i.e. screw-in base 7, at least at two spaced portions 14 and 19.

The method of assembling the lamp according to the invention is explained below.

The first step comprises preparing the vitreous envelope 1 in a proper upstanding position.

Next, the circular protruded ring 15 is provided with suitable silicone rubber adhesive, the quantity being between 0.001 grams and 0.1 grams, spread very thinly across the surface of the ring 15.

Thirdly follows bending one of the lead-in wires around the outer tube portion 16, and adjusting the length of the wire by cutting thereof.

Fourthly, the screw-in base 7 is capped over the tube portion 16 of the envelope by a push-in operation. Once the flared rim 11 moves past the circular protruded ring 15 the axial movement of the screw-in base is to a great degree limited and it is virtually immovable.

Finally, heat is applied over those areas of the screw-in base 7, to the inner side of which is applied silicone rubber adhesive, bringing up the temperature of the adhesive to somewhere between 100° C. and 200° C. to vulcanize or harden the adhesive.

A typical incandescent lamp assembly according to the invention requires 0.05 grams of silicone rubber adhesive as opposed to the 2.0 grams of cement required in a typical conventional lamp assembly, thus leading to a cost reduction of about 0.16 per lamp.

While we have hereinabove described a preferred form of the invention, obvious equivalent variations are possible in light of the above teachings. It is therefore to be understood that, within the scope of the appended claims, the invention may be practiced otherwise than as specifically described, and the claims are intended to cover such equivalent variations.

What is claimed as new and desired to be secured by letters patent of the United States is:

1. A lamp assembly including a light generating source to be connected directly to a power outlet, said lamp assembly comprising:

(a) a vitreous envelope including a generallly cylindrical neck at one end thereof, said generally cylindrical neck having, a circular outwardly protruded ring extending about the entire periphery of said neck, and an outwardly expanding circumferential skirt which adjoins said circular protruded ring;

(b) a stem mount integrally connected with said envelope and provided inside thereof with a pair of lead-in wires for supporting said light generating source and for supplying electric power thereto, said wires extending across and outwardly from said stem mount;

(c) a screw-in base adapted to be assembled to said vitreous envelope for connection to an external lighting fixture for electric power supply, said stem including a generally cylindrical shaped screwshell provided with a concave annular channel formed inside said screwshell and extending along the entire internal surface thereof, and a flared rim disposed next to said concave channel and expanding outwardly in the direction of said envelope, said rim defining an edge of said screwshell; and (d) adhesive filling means provided in a space defined by said generally cylindrical neck and said screwshell for fixedly combining said two elements, whereby said circular protruded ring and said outwardly expanding skirt are respectively engaged with said concave channel and said flared rim, and further wherein one of said lead-in wires is securely held in a space defined by an external surface of said generally cylindrical neck of said envelope and an internal surface of said screwshell for providing firm electrical contact.

2. A lamp assembly according to claim 1, wherein said filling means for combining said envelope and said screw shell includes heat-hardening type silicone rubber adhesives.

3. A lamp assembly according to claim 1, wherein one of said lead-in wires is tightly secured by an internal surface of said concave channel of said screw shell and an external surface of said circular protruded ring.

4. A lamp according to claim 3, wherein said screwshell is further provided with a groove between turns of a screw thread of said shell, wherein a gap between an inner surface of said groove and said external surface of said generally cylindrical neck is made smaller than a diameter of said lead-in wire and whereby said lead-in wire, when secured, expands said groove outwardly and is immovably fixed.

5. A lamp assembly according to claim 1, wherein said lamp assembly defines an incandescent lamp.

6. A lamp assembly according to claim 5 wherein said screw-in base is provided with threads to directly connect to an external lighting fixture.

* * * * *